US007293501B2

(12) United States Patent
Lee

(10) Patent No.: US 7,293,501 B2
(45) Date of Patent: Nov. 13, 2007

(54) PRESS WITH COMPACT WORM UNIT

(76) Inventor: Chia Shun Lee, P.O. Box 44 - 2049, Taipei (TW) 10668

( * ) Notice: Subject to any disclaimer, the term of this patent is extended or adjusted under 35 U.S.C. 154(b) by 0 days.

(21) Appl. No.: 11/352,208

(22) Filed: Feb. 13, 2006

(65) Prior Publication Data

US 2007/0163453 A1 Jul. 19, 2007

(30) Foreign Application Priority Data

Jan. 16, 2006 (TW) ..... 95200906 U

(51) Int. Cl.
*B30B 3/04* (2006.01)

(52) U.S. Cl. ..... 100/176; 100/288; 269/21; 269/95; 248/362; 248/363

(58) Field of Classification Search ..... 100/76, 100/121, 155 R, 159, 161, 172, 173, 176, 100/280, 282, 288, 292; 68/97, 98, 99, 244; 271/272, 273; 269/21, 95; 248/362, 363
See application file for complete search history.

(56) References Cited

U.S. PATENT DOCUMENTS 2,123,703 A * 7/1938 Loose et al. ..... 99/450.2
2,845,864 A * 8/1958 Davidson ..... 101/350.1
3,159,370 A * 12/1964 Rubinstein ..... 248/346.01
4,081,145 A * 3/1978 Moe et al. ..... 241/93
5,647,260 A * 7/1997 Nabity ..... 83/522.12
5,961,779 A * 10/1999 Bradshaw ..... 156/495
6,220,136 B1 * 4/2001 Benes et al. ..... 83/566
2005/0253324 A1 * 11/2005 Corcoran et al. ..... 271/15
2006/0284043 A1 * 12/2006 Paradise et al. ..... 248/362

FOREIGN PATENT DOCUMENTS

GB 2067120 A * 7/1981

* cited by examiner

*Primary Examiner*—Jimmy T. Nguyen
(74) *Attorney, Agent, or Firm*—Alan Kamrath; Kamrath + Associates P.A.

(57) ABSTRACT

A press includes an arm mechanism to input force transferred to upper and lower rollers by a worm unit. The worm unit occupies less space so that even if the size of the press is increased, the worm unit can be used without too much change. The handle is located on a top of the casing of the press and is formed together with the casing of the press. A suction mechanism is located on an underside of the base part of the casing and is controlled by a lever. A platform is independently connected to the casing.

6 Claims, 3 Drawing Sheets

PRESS WITH COMPACT WORM UNIT

BACKGROUND OF THE INVENTION (1) Field of the Invention

The present invention relates to a press for press patterns on sheets of paper product and, more particularly, to a press that is able to press large sized sheets without increasing the size of the press.

(2) Description of the Prior Arts

A conventional press for pressing patterns on paper sheets generally includes 13 cm of height, 13 cm of width and 11 cm of depth. The plates for clamping the paper sheets is 15 cm of length and 7 cm of width. The thickness of the two plates is about 0.8 cm. In other words, the width of the rollers is about 8 cm and a gap between the upper and lower rollers is about 0.8 cm. Furthermore, the mold is 6.5 cm of width and 4.5 cm of length. The total thickness of the two molding plates, the paper sheets and the clamping device for clamping the molding plates is about 0.2-0.3 cm. The thickness of the etching mold is about 0.1 cm, and the thickness of the pressing plate has to be increased. The paper sheets are fed into the gap between the upper and lower rollers by rotating a handle to operate a gear set which reduces the effort that the user inputs the press to make the upper and lower rollers to be rotated in opposite directions. Generally, the handle is rotated clockwise to drive a spur gear with small size, and the spur gear with small size drives a spur gear with large size counter clockwise. Another spur gear of small size sharing the same axis of the spur gear with large size is rotated and drives the lower roller to rotate clockwise. A spur gear is connected to a remote end of the lower roller and drives another spur gear on the upper roller so that the upper and lower rollers are rotated in opposite directions to feed the paper sheets forward to finish the engraving or printing processes.

There are several shortcomings for the conventional press mechanism. The first one is that the press mechanism needs many gears. The second shortcoming is that the gears occupy most of the space of the press so that the conventional press is difficult to be improved without increasing its size. The third shortcoming is that the lower roller transfers the energy from one end to the other so as to drive the upper roller and this causes tremendous energy loss. The fourth shortcoming is that if the size of the conventional press is to be increased so as to deal with larger sized paper sheets, there are many difficulties to re-arrange the gears. Besides, the handle is located at a side of the press and makes the press unstable.

The present invention intends to provide a press mechanism with compact size and that uses a worm unit cooperated with worm gears so that the press mechanism can be efficiently operated. The press mechanism is allowed to press A4 size paper sheets.

SUMMARY OF THE INVENTION

The present invention relates to a press including a casing and an arm mechanism connected to a side of a top of the casing. A roller unit is driven by a worm unit which is activated by operation of the arm mechanism. A handle is connected to a top of the casing of the press, and a platform is independently connected to the casing. A suction mechanism is connected to an underside of the base part of the casings.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
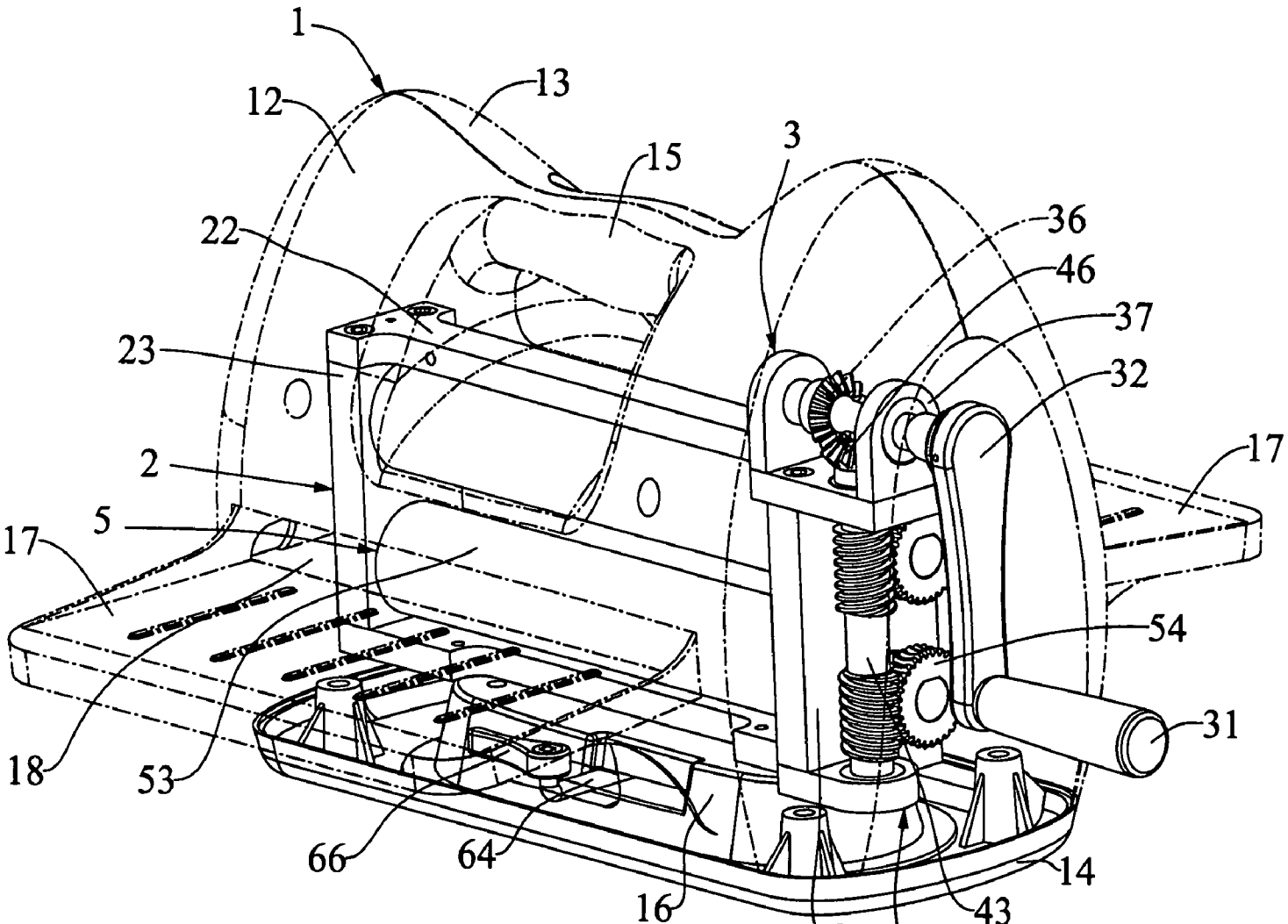
FIG. 1 is a perspective view to show the press of the present invention, with the casing shown in dotted line.
Figure 2:
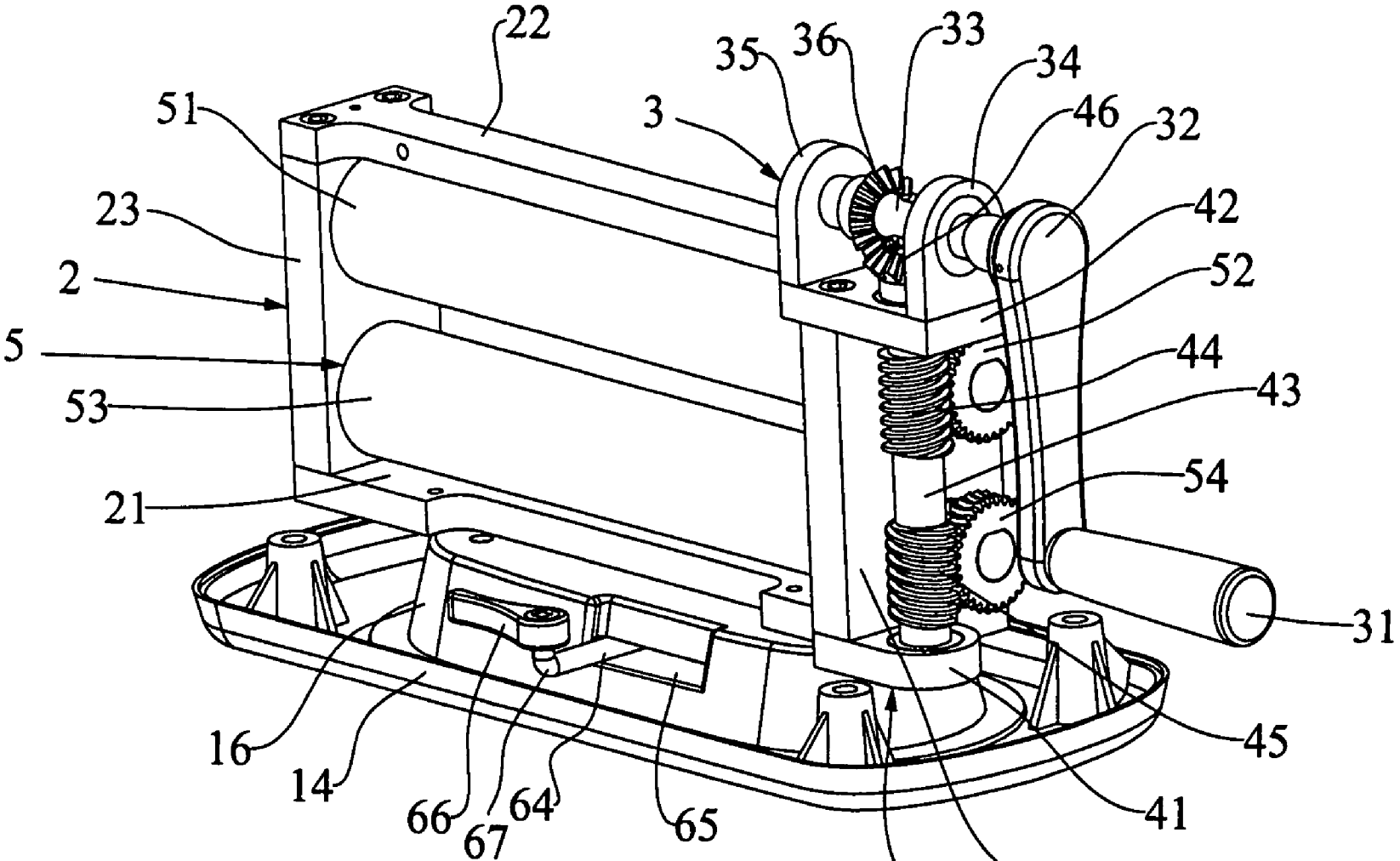
FIG. 2 shows a perspective view of the press of FIG. 1 without the casing.
Figure 3:
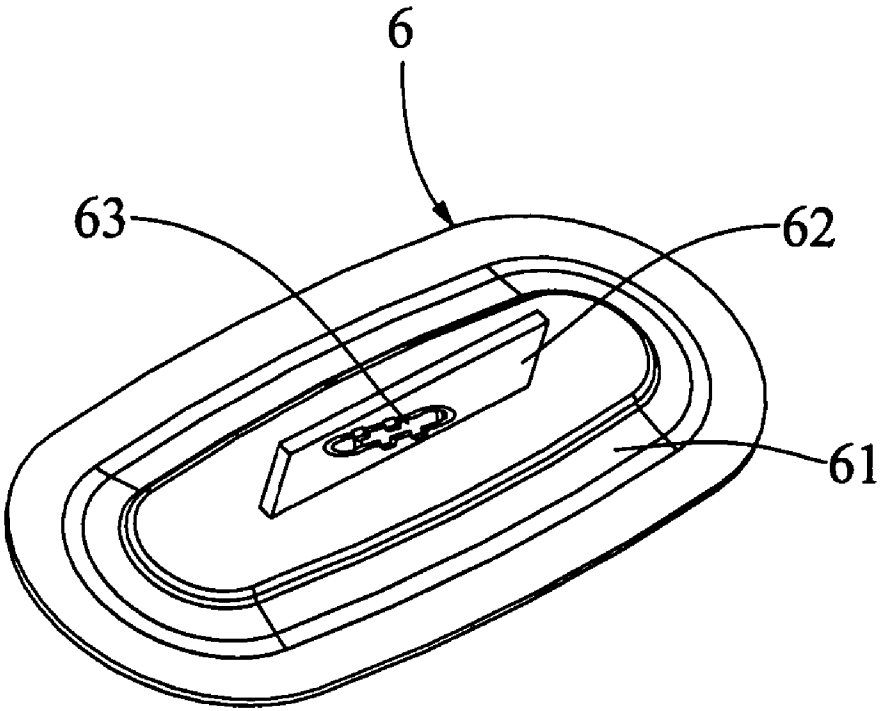
FIG. 3 shows a perspective view of a suction disk with the guide plate of the press of FIG. 1.

Referring to FIGS. 1 to 3, the press of the present invention includes a frame 2 having a base portion 21, a top portion 22, a left wall 23 and worm wall 24. The base portion 21 and the top portion 22 are connected between the left wall 23 and worm wall 24. A casing 1 is mounted to the frame 2 and includes a front part 12, a rear part 13 and a base part 14. A handle 15 is connected on a top of the casing 1, and a platform 17 is independently connected to an engaging slot 18 defined in the casing 1 when needed.

An arm mechanism 3 is connected to a side of the frame 2, and a worm unit 4 is connected to the frame 2 and mechanically connected to the arm mechanism 3. The arm mechanism 3 includes a right arm support 34 and a left arm support 35. A shaft 33 of the arm mechanism 3 is rotatably connected between the right arm support 34 and the left arm support 35. A first bevel gear 36 is connected to the shaft 33 of the arm mechanism 3 so as to be engaged with a second bevel gear 46 on the worm 43. The shaft 33 of the arm mechanism 3 is connected to a crank 32, and a grip 31 is connected to the crank 32 so that the user can rotate the arm mechanism 3 by operating the grip 31.

A roller unit 5 includes an upper roller 51 and a lower roller 53. A first worm gear 52 is connected to the upper roller 51, and a second worm gear 54 is connected to the lower roller 53. The upper and lower rollers 51 and 53 are connected between the left wall 23 and the worm wall 24.

The worm unit 4 includes the worm 43 which has a lower end pivotably connected to a worm seat 41 connected to the base portion 21. A top end of the worm 43 extends through a worm top board 42 which is connected to the top portion 22. The worm 43 has an upper worm wheel 44 which is engaged with the first worm gear 52 on the upper roller 51. A lower worm wheel 45 is connected to the worm 43 so as to be engaged with the second worm gear 54 on the lower roller 53.

The upper roller 51 is rotated counter clockwise, and the lower roller 53 is rotated clockwise so that the molding plates and the paper sheets are fed forward. The shaft 33 of the arm mechanism 3, the worm 43 and the upper and lower rollers 51, 53 are connected to the frame 2 by bearings.

A suction mechanism 6 is connected to a suction pad room 16 in an underside of the base part 14 and includes a suction disk 61. A guide plate 62 is connected to the suction disk 61. An inclined slot 63 is defined through the guide plate 62. A lever 64 has a pivot 67 on a first end thereof. A second end of the lever 64 is inserted into a hole 65 in the base part 14 of casing 1 and through the inclined slot 63. Thus, the suction disk 61 is moved up and down by moving the lever 64. A bar 66 is pivotably connected to the pivot 67 of the lever 64 so that the lever 64 does not extend beyond the base part 14. Thus, when not in use, the bar 66 is pivoted close to the base part 14 of the casing 1. When it is desired to move suction disk 61 up or down, bar 66 can be pivoted about pivot 67 away from the base part 14 of the casing 1 and then used to move lever 64 in the hole 65 and the inclined slot 63 to thereby move the suction disk 61.

While we have shown and described the embodiment in accordance with the present invention, it should be clear to those skilled in the art that further embodiments may be made without departing from the scope of the present invention.

What is claimed is:

1. A press comprising:

a casing;

a roller unit mounted to the casing, with the roller unit including upper and lower rollers for pressing material therebetween; and a suction mechanism, wherein the suction mechanism includes a suction disk received in a suction pad room in a base part of the casing, a guide plate connected to a top of the suction disk, an inclined slot defined through the guide plate, a lever having a pivot on a first end thereof, with a second end of the lever inserted into a hole in the base part of the casing and through the inclined slot, wherein the suction disk is moved up and down by operating the lever, and a bar pivotably connected to the first end of the lever so that the lever does not extend beyond the base part.

2. The press as claimed in claim 1 further comprising:

an arm mechanism; and a worm unit wherein the worm unit includes a worm which has a lower end pivotably connected to a worm seat and which has a top end extending through a worm top board, wherein the top end of the worm is connected to a bevel gear engaged with another bevel gear on the arm mechanism, wherein the worm is cooperated with a first worm gear on the upper roller and a second worm gear on the lower roller, wherein the upper roller and the lower roller rotate in opposite directions.

3. The press as claimed in claim 1 further comprising:

a handle connected to a top of the casing.

4. The press as claimed in claim 3 further comprising:

a platform independently connected to the casing and aligned between the upper and lower rollers.

5. The press as claimed in claim 4 further comprising:

an arm mechanism; and a worm unit, wherein the worm unit includes a worm which has a lower end pivotably connected to a worm seat and which has a top end extending through a worm top board, wherein the top end of the worm is connected to a bevel gear engaged with another bevel gear on the arm mechanism, wherein the worm is cooperated with a first worm gear on the upper roller and a second worm gear on the lower roller, wherein the upper roller and the lower roller rotate in opposite directions.

6. The press as claimed in claim 3 further comprising:

an arm mechanism; and a worm unit, wherein the worm unit includes a worm which has a lower end pivotably connected to a worm seat and which has a top end extending through a worm top board, wherein the top end of the worm is connected to a bevel gear engaged with another bevel gear on the arm mechanism, wherein the worm is cooperated with a first worm gear on the upper roller and a second worm gear on the lower roller, wherein the upper roller and the lower roller rotate in opposite directions.

* * * * *